US010233822B2

(12) United States Patent
Nishiguchi et al.

(10) Patent No.: US 10,233,822 B2
(45) Date of Patent: Mar. 19, 2019

(54) EXPANSION TANK

(71) Applicant: Hitachi Construction Machinery Co., Ltd., Bunkyo-ku, Tokyo (JP)

(72) Inventors: Hitoshi Nishiguchi, Tsuchiura (JP); Tomoyuki Saito, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 446 days.

(21) Appl. No.: 15/000,501

(22) Filed: Jan. 19, 2016

(65) Prior Publication Data

US 2016/0222869 A1 Aug. 4, 2016

(30) Foreign Application Priority Data

Jan. 29, 2015 (JP) ..... 2015-016041

(51) Int. Cl.
*F01P 3/22* (2006.01)
*F01P 11/02* (2006.01)

(52) U.S. Cl.
CPC ..... *F01P 11/029* (2013.01)

(58) Field of Classification Search
CPC ..... F01P 11/029; F01P 11/028; F01P 11/0285
USPC ..... 123/41.54, 41.27, 104.32
See application file for complete search history.

(56) References Cited

U.S. PATENT DOCUMENTS 5,111,776 A 5/1992 Matsushiro et al.
5,135,049 A * 8/1992 Attinger ..... F01P 11/029 123/41.51
5,256,026 A * 10/1993 Kishi ..... E02F 3/3631 403/321
5,680,833 A 10/1997 Smith
6,216,646 B1 * 4/2001 Smith ..... F01P 11/029 123/41.54
6,708,653 B2 * 3/2004 Lefrançois ..... F01P 11/029 123/41.54

(Continued)

FOREIGN PATENT DOCUMENTS

JP 3867607 B2 1/2007

OTHER PUBLICATIONS

Extended European Search Report issued in counterpart European Application No. 15196842.7 dated Apr. 4, 2016 (Ten (10) pages).

*Primary Examiner* — Marguerite McMahon
*Assistant Examiner* — James Kim
(74) *Attorney, Agent, or Firm* — Crowell & Moring LLP

(57) ABSTRACT

An expansion tank, while maintaining gas-liquid separation performance of coolant circulating through an engine cooling apparatus, can absorb pressure variations occurring with volume change of the coolant even when an excessive amount of coolant is supplied. A bulkhead 42 partitions an expansion tank 30 into separate chambers R1 to R6 that communicate with each other via a first communication hole 44 positioned lower than a FULL line. The separate chambers R4 to R6 that constitute a separate chamber group X communicate with each other via a third communication hole 45*a* positioned higher than the FULL line. The separate chambers R1 to R3 that constitute a separate chamber group Y communicate with each other via a fourth communication hole 45*b* positioned higher than the FULL line. The separate chamber R1 and the separate chamber R4 communicate with each other via a second communication hole 45*c* disposed at the height of the FULL line.

3 Claims, 19 Drawing Sheets

(56) References Cited

U.S. PATENT DOCUMENTS

| | | | | |
|---|---|---|---|---|
| 7,188,588 | B2 * | 3/2007 | Hewkin | F01P 11/0238 123/41.54 |
| 8,038,878 | B2 * | 10/2011 | Hewkin | B01D 35/027 137/544 |
| 8,443,767 | B2 * | 5/2013 | Murphy | F01P 11/0285 123/41.54 |
| 2007/0175418 | A1 * | 8/2007 | Prince | F01P 11/0285 123/41.51 |
| 2007/0215073 | A1 | 9/2007 | Lawrence et al. | |
| 2016/0272383 | A1 * | 9/2016 | Ramus | B65D 51/1638 |

* cited by examiner

A1-A1

B1-B1

C1-C1

C1-C1

D1-D1

D1-D1

A2−A2

B2–B2

C2-C2

C2-C2

D2-D2

EXPANSION TANK

BACKGROUND OF THE INVENTION

1. Field of the Invention

The present invention relates generally to engine cooling apparatuses and, more particularly, to an expansion tank that absorbs pressure variations occurring with volume change of coolant that circulates through the engine cooling apparatus, and separates the coolant into gas and liquid.

2. Description of Related Art

A construction machine such as a hydraulic excavator generally includes an engine serving as a prime mover, and an engine cooling apparatus that cools the engine by allowing coolant to circulate through a coolant circuit between the engine and a radiator. The coolant circuit often includes a hermetic reservoir tank (what is called an expansion tank) that removes air from the coolant and make an internally reserved air chamber act as an air spring to absorb pressure variations occurring with volume change of the coolant.

The expansion tanks in the conventional technique have a plurality of separate chambers partitioned from each other by a bulkhead. Such separate chambers each have a coolant communication hole in the bottom of the chambers, the coolant communication hole providing coolant circulation between the separate chambers. In addition, the separate chambers each have an air communication hole in an upper portion of the chambers, the air communication hole providing air circulation between air chambers reserved in the respective separate chambers. The coolant introduced into the expansion tank from the coolant circuit, while flowing through the separate chambers, is subjected to gas-liquid separation before being delivered to the coolant circuit.

In such an expansion tank, however, the air chamber reserved in each separate chamber has a capacity varying with an amount of coolant supplied to the expansion tank. Thus, when an excessive amount of coolant is supplied to the expansion tank, the capacity of the air chamber reserved in each separate chamber is reduced. As a result, pressure variations occurring with the volume change of coolant will be insufficiently absorbed, so that an inordinately increased internal pressure of the coolant circuit damages some parts of the coolant circuit. As a solution to this problem, Japanese Patent No. 3867607, for example, discloses an expansion tank that can absorb pressure variations occurring with the volume change of coolant even when an excessive amount of coolant is supplied by a user.

The expansion tank disclosed in Japanese Patent No. 3867607 includes a separate chamber that only has a coolant communication hole. This arrangement of the coolant communication hole in the separate chamber provides an air chamber at the area higher than the hole regardless of the amount of coolant supplied to the expansion tank. The pressure variations occurring with the volume change of coolant can thus be absorbed even when an excessive amount of coolant is supplied to the expansion tank.

SUMMARY OF THE INVENTION

The expansion tank disclosed in Japanese Patent No. 3867607 has an intake port configured to introduce coolant from an engine cooling apparatus and a delivery port configured to deliver the coolant from the expansion tank to the engine cooling apparatus, the intake port and the delivery port both communicating with the same separate chamber. As a result, the coolant flows past the separate chamber a smaller number of times, and a flow path formed in the expansion tank becomes shorter, making the expansion tank fail to offer sufficient gas-liquid separation performance of the coolant. A longer flow path may be formed by having the intake port and the delivery port communicating with different separate chambers and disposing the separate chamber that has only the coolant communication hole, between the separate chamber with the intake port and the separate chamber with the delivery port. The separate chamber having only the coolant communication hole, however, has a coolant level lower than the other separate chambers. This can lead to turbulence in the coolant flowing through this separate chamber and consequently foams in the coolant, thus resulting in a degraded gas-liquid separation performance.

The present invention has been made in view of the foregoing situation and it is an object of the present invention to provide an expansion tank that can absorb pressure variations occurring with volume change of coolant that circulates through an engine cooling apparatus even when an excessive amount of the coolant is supplied.

To solve the foregoing problem, an aspect of the present invention provides an expansion tank disposed in an engine cooling apparatus. The expansion tank performs, in a condition of being closed from an atmosphere, gas-liquid separation of coolant that circulates through the engine cooling apparatus. The expansion tank includes: first and second separate chambers defined in the expansion tank and separated from each other by a bulkhead; an intake port formed so as to open into the first separate chamber, the intake port allowing coolant to be introduced into the expansion tank from the engine cooling apparatus; a delivery port formed so as to open into the second separate chamber at a lower position than a predetermined height, the delivery port allowing coolant to be delivered from the expansion tank to the engine cooling apparatus; and a coolant supply port formed so as to open into the first separate chamber at a higher position than at the predetermined height, the coolant supply port allowing coolant to be supplied to the expansion tank. The first and second separate chambers communicate with each other via first and second communication holes. The first communication hole is formed at a lower position than the predetermined height in the bulkhead to allow coolant to circulate, and the second communication hole is formed at the predetermined height in the bulkhead so that a coolant level of the second separate chamber is maintained at or below the predetermined height.

The aspect of the present invention having the configuration as described above maintains gas-liquid separation performance by keeping the coolant at predetermined or higher coolant levels in the separate chambers (the first separate chamber and the second separate chamber) through which the coolant flows. In addition, an air chamber is secured at an upper portion above a predetermined height in the second separate chamber regardless of the amount of coolant supplied to the expansion tank. Thus, the aspect of the present invention can absorb pressure variations occurring with volume change of the coolant that circulates through the engine cooling apparatus, even when the expansion tank is supplied with an excessive amount of coolant.

An expansion tank according to the present invention, while maintaining gas-liquid separation performance of coolant circulating through an engine cooling apparatus, can absorb pressure variations occurring with volume change of the coolant, even when an excessive amount of coolant is supplied.

BRIEF DESCRIPTION OF THE DRAWINGS

The present invention will be described hereinafter with reference to the accompanying drawings in which.

DETAILED DESCRIPTION OF EMBODIMENTS

Embodiments of the present invention will be described below with reference to the accompanying drawings. The present invention will be described with particular reference to embodiments in which the invention is applied to an engine cooling apparatus mounted in a crawler hydraulic excavator. It should, however, be understood that the invention is widely applicable to engine cooling apparatuses mounted on various other types of construction machines, including a wheel hydraulic excavator, a hydraulic crane, a wheel loader, and a tractor, as long as the engine cooling apparatus circulates coolant between a radiator and an engine to cool the engine.

First Embodiment

A first embodiment of the present invention will be described below with reference to FIGS. 1 to 9B.

Figure 1:
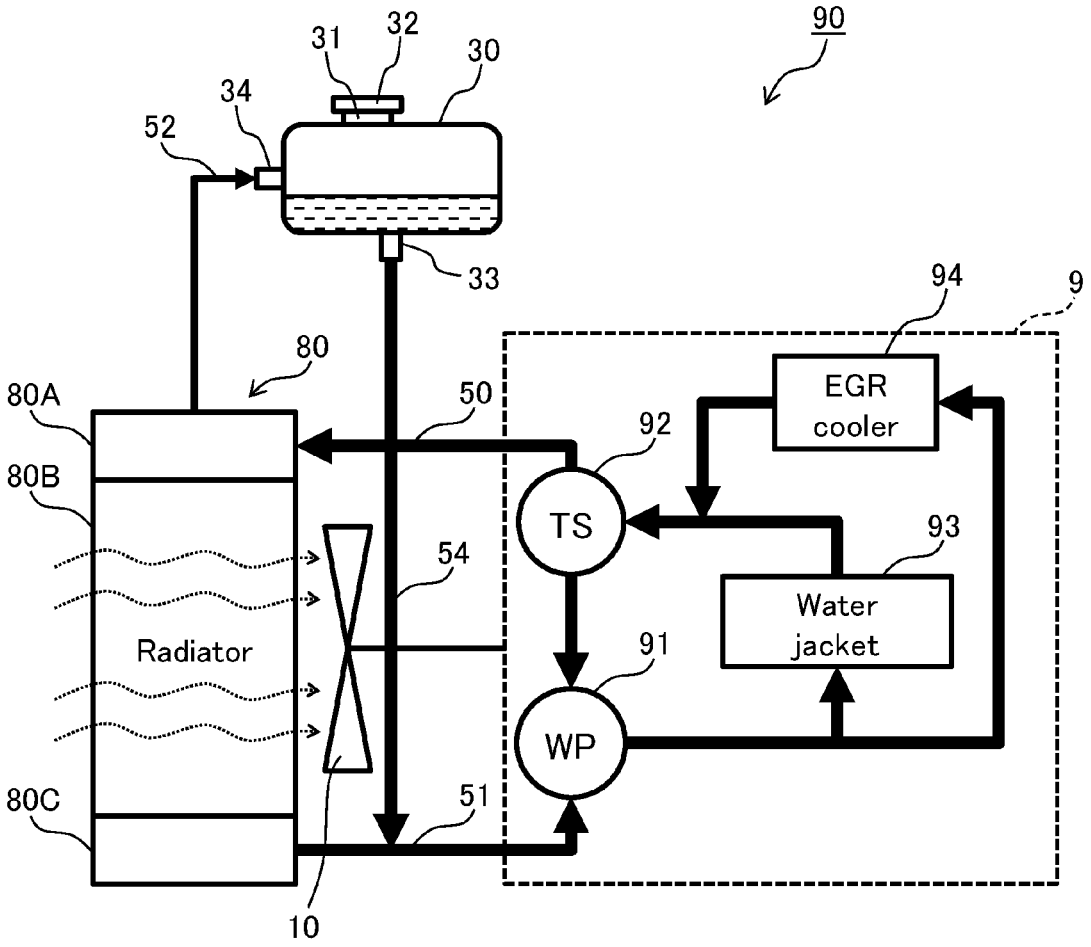
FIG. 1 is a diagram showing an overall configuration of an engine cooling apparatus that includes an expansion tank according to a first embodiment of the present invention.

FIG. 1 is a diagram showing an overall configuration of an engine cooling apparatus that includes an expansion tank according to the first embodiment. An engine cooling apparatus 90 includes a radiator 80, a water pump 91, a thermostat 92, a water jacket 93, an exhaust gas recirculation (EGR) cooler 94, and an expansion tank 30. The arrows in FIG. 1 each denote a flow path (including a pipe and a hose) and a flow direction of coolant (including a case where the coolant contains air).

The radiator 80 includes an upper tank 80A, a radiator core 80B, and a lower tank 80C. Specifically, the upper tank 80A receives coolant that flows in from an engine 9 via a radiator upper hose 50. The radiator core 80B is connected to a lower side of the upper tank 80A. The radiator core 80B includes a plurality of coolant capillary tubes and a plurality of heat radiating fins disposed on outer peripheries of the coolant capillary tubes. The lower tank 80C is connected to a lower side of the radiator core 80B. The lower tank 80C allows coolant cooled by the radiator core 80B to flow to the engine 9 via a radiator lower hose 51. The heat of coolant introduced to the coolant capillary tubes of the radiator core 80B is radiated by cooling air drawn in from the outside by a cooling fan 10 that is rotatably driven by the engine 9. It is noted that, instead of the engine 9, an electric motor or any other driving source may be employed to drive the cooling fan 10.

The water pump 91 is driven by power provided by the engine 9. The water pump 91 delivers coolant drawn in from the thermostat 92 or the lower tank 80C toward the water jacket 93 or the EGR cooler 94, thereby circulating the coolant.

The water jacket 93 serves as a water path disposed around a cylinder (not shown) of the engine 9. The coolant delivered from the water pump 91 mainly exchanges heat with the engine 9 while passing through the water jacket 93 to cool the engine 9.

The EGR cooler 94 is disposed in an EGR line (not shown). The EGR cooler 94 makes part of engine exhaust emissions (hereinafter referred to as an EGR gas) that flow through the EGR line exchange heat with the coolant, thereby cooling the EGR gas. The cooled EGR gas is mixed with intake air and introduced again into the cylinder. The EGR cooler 94 and a cooling system associated the EGR cooler 94 may be omitted.

The thermostat 92 is a valve mechanism that opens and closes a coolant path in accordance with a coolant temperature. The thermostat 92 opens when the coolant temperature is higher than or equal to a valve opening temperature, allowing the coolant to be introduced into the radiator 80. The thermostat 92 is closed when the coolant temperature is lower than the valve opening temperature, allowing the coolant to circulate without being introduced into the radiator 80. It is noted that, in FIG. 1, the thermostat 92 is disposed in an outgoing flow path through which the coolant flows to the outside (the upper tank 80A) of the engine 9 (the water jacket 93 and the EGR cooler 94). The thermostat 92 may nonetheless be disposed in an incoming flow path through which the coolant flows from the outside (the upper tank 80A) to the inside (the water pump 91) of the engine 9.

The expansion tank 30 is a hermetic reservoir tank. The expansion tank 30, while removing air from (performing gas-liquid separation of) the coolant that circulates through the engine cooling apparatus 90, makes an air chamber in itself act as an air spring, thereby absorbing pressure variations in a coolant circuit occurring with volume change of the coolant.

The expansion tank 30 has a coolant supply port 31 disposed on a top surface of itself. The coolant supply port 31 is used for supplying the expansion tank 30 with coolant. The coolant supply port 31 is fitted with a cap 32 except during supply of the coolant. After the coolant has been fed, the cap 32 is tightened to completely close the expansion tank 30. In some embodiments, an upper portion of the expansion tank 30 or the cap 32 includes a pressure valve (not shown) that can adjust the air pressure inside the expansion tank 30.

The expansion tank 30 further has an air bleeder port 34 disposed on a lateral surface of itself at a position higher than a coolant level. An air bleeder line 52 for introducing coolant containing the air from the radiator 80 has one end connected to the air bleeder port 34. The air bleeder line 52 has the other end connected to an upper end portion of the upper tank 80A of the radiator 80.

The expansion tank 30 has a make-up port 33 disposed at a bottom surface of itself. The coolant from which the air has been removed is delivered through the make-up port 33 to the coolant circuit. A make-up line 54 is disposed substantially in a vertical direction below the expansion tank 30. The make-up line 54 has an upper end attached to the make-up port 33. The make-up line 54 has a lower end connected to the radiator lower hose 51. Additionally, the expansion tank 30 is disposed such that the make-up port 33 is higher than an uppermost portion of an internal cavity of the upper tank 80A. The coolant introduced through the air bleeder line 52 to the expansion tank 30 is thereby subjected to gas-liquid separation inside the expansion tank 30 before being supplied to the radiator lower hose 51 via the make-up line 54. It is noted that, in FIG. 1, the air bleeder line 52 is connected to a lateral surface of the expansion tank 30. The air bleeder line 52 may nonetheless be connected to the top surface or the bottom surface of the expansion tank 30.

Figure 2:
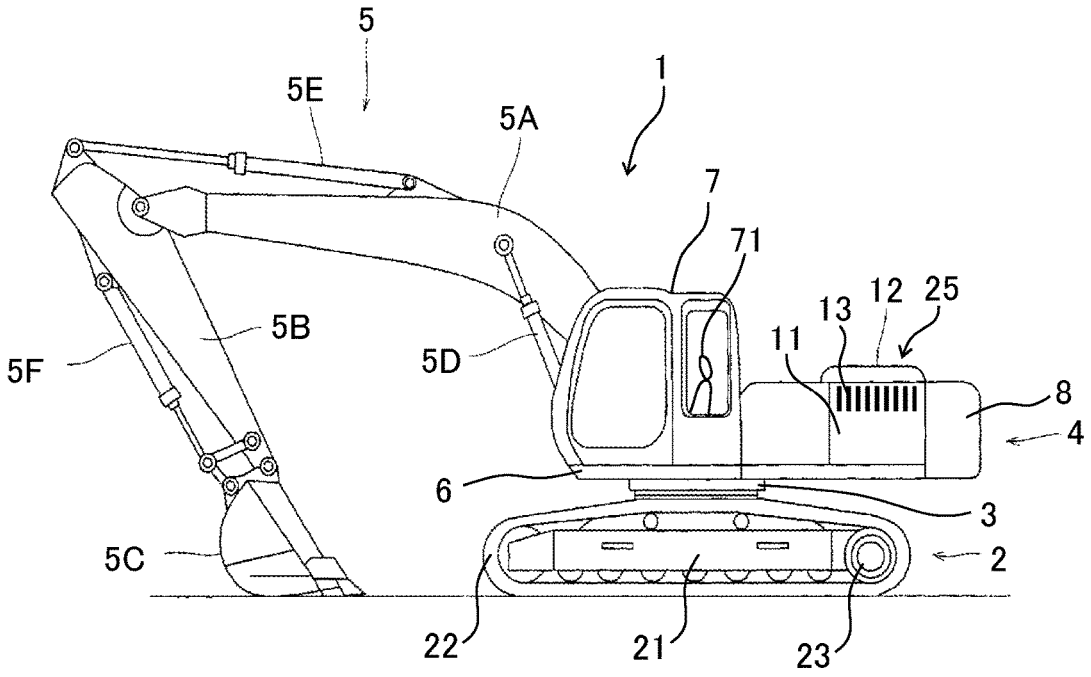
FIG. 2 is a side view showing a hydraulic excavator according to embodiments of the present invention.

FIG. 2 shows the appearance of a hydraulic excavator as an exemplary construction machine on which the engine cooling apparatus 90 is mounted. This hydraulic excavator 1 typically includes a lower track structure 2, an upper swing structure 4, and a work implement 5. The lower track structure 2 is self-driven. The upper swing structure 4 is mounted swingably on the lower track structure 2. The work implement 5 performs such a type of work as, for example, excavating earth. It is noted that the terms "front," "rear," "left," and "right," as used in the following, are based on an operator sitting in an operator seat 71.

The lower track structure 2 includes left and right crawler frames 21, left and right crawlers 22 respectively wound over the left and right crawler frames 21, and left and right track motors 23 (FIG. 2 shows ones on the left-side only) that independently drive the left and right crawlers 22, respectively.

The upper swing structure 4 includes a swing frame 6 serving as a supporting mechanism. A cab 7 is disposed on the left side of a front portion of the swing frame 6. The operator seat 71 in which the operator sits, operating levers (not shown) for operating hydraulic actuators 2A, 5D, 5E, and 5F, and other devices are disposed inside the cab 7. A counterweight 8 that offsets the work implement 5 is disposed at a rear end portion of the swing frame 6. A machine chamber 25 is defined at a rear portion of the swing frame 6 by an outer cover 11, an engine cover 12, and the counterweight 8, etc. The machine chamber 25 includes the engine 9 (see FIG. 1) serving as the prime mover, the engine cooling apparatus 90 (see FIG. 1), a hydraulic pump driven by the engine 9, a swing motor (not shown) that drives a swing mechanism 3 and thus swings the upper swing structure 4 (the swing frame 6) with respect to the lower track structure 2, control valves that supply hydraulic fluid delivered from the hydraulic pump to the respective hydraulic actuators 2A, 5D, 5E, and 5F, and other units. Additionally, the outer cover 11 has a flow-in port 13 with a plurality of vertically long slits through which cooling air is supplied to the engine cooling apparatus 90 (the radiator 80).

The work implement 5 includes a boom 5A, an arm 5B, and a bucket 5C. The boom 5A is mounted on the upper swing structure 4 so as to be capable of ascending and descending. The arm 5B is rotatably mounted at a distal end of the boom 5A. The bucket 5C is rotatably mounted at a distal end of the arm 5B. The boom 5A ascends and descends through extension and contraction of the boom cylinder 5D. The arm 5B rotates through extension and contraction of the arm cylinder 5E. The bucket 5C rotates through extension and contraction of the bucket cylinder 5F.

The following describes, with reference to FIGS. 3 to 8, a configuration of the expansion tank (hereinafter referred to simply as the "tank") 30 included in the engine cooling apparatus 90.

Figure 3:
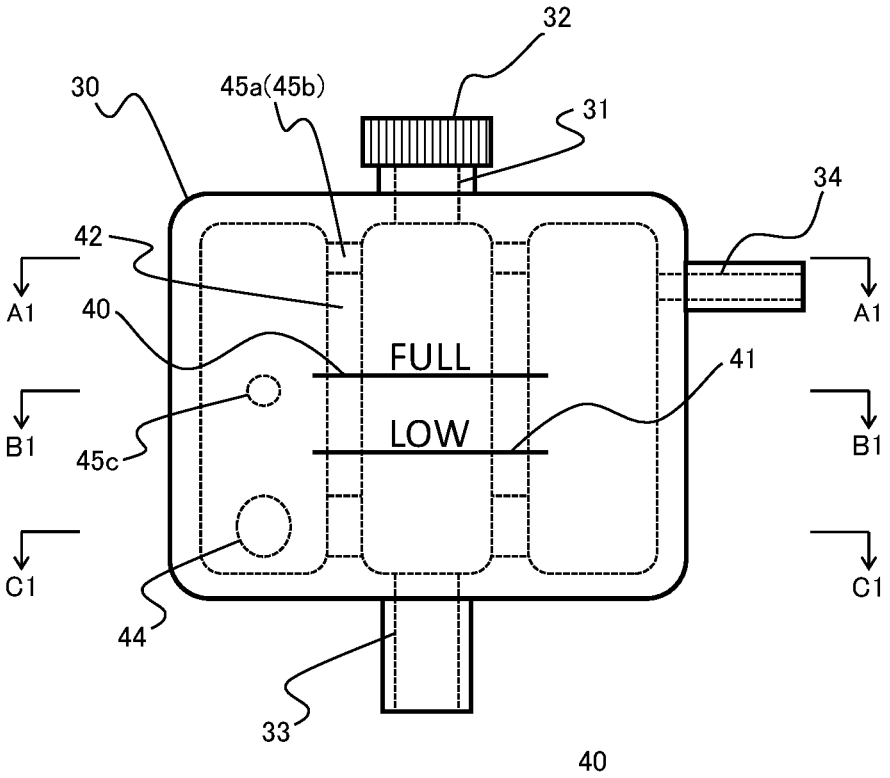
FIG. 3 is a side view showing the expansion tank according to the first embodiment.
Figure 4:
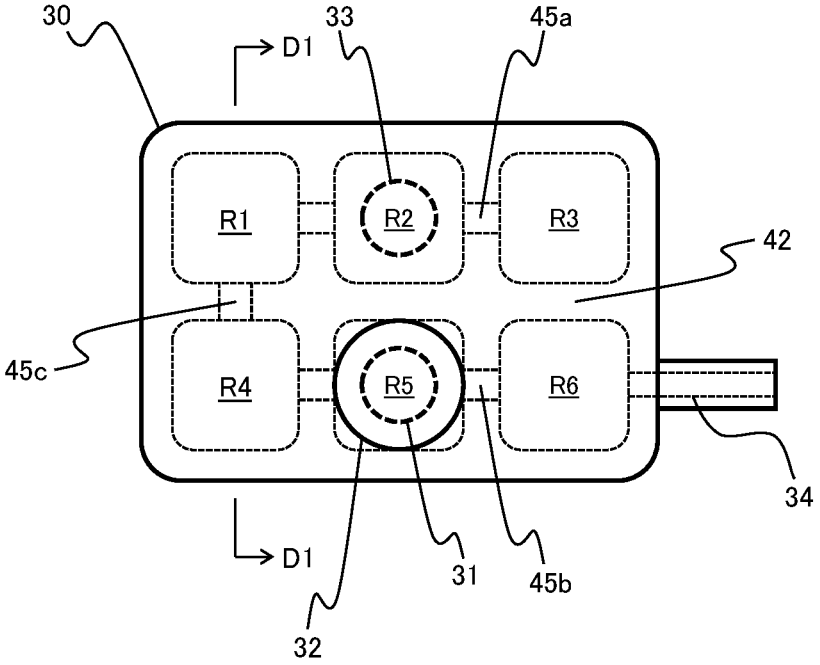
FIG. 4 is a top view showing the expansion tank according to the first embodiment.

FIG. 3 is a side view showing the tank 30. FIG. 4 is a top view showing the tank 30. The tank 30 has an inside partitioned by a bulkhead 42 into six separate chambers R1 to R6. The separate chambers R1 to R6 are adjacent to each other in forward-backward and left-right directions and each have a quadrangular prism shape. The tank 30 has the coolant supply port 31 provided in the top surface of the tank 30. The coolant supply port 31 through which the coolant is supplied to the tank 30 is formed so as to open into the separate chamber R5. Except during the supply of the coolant, the cap 32 with a pressure valve is attached to the upper end of the coolant supply port 31. The air bleeder port 34 to which the air bleeder line 52 is connected is formed in a lateral surface of the tank 30 so as to open into the separate chamber R6. The make-up port 33 to which the make-up line 54 is attached is formed in the bottom surface of the tank 30 so as to open into the separate chamber R2. The tank 30 has a lateral surface which the operator can visually inspect. This lateral surface of the tank 30 is marked with a FULL line 40 and a LOW line 41. The FULL line 40 serves as a guide for the coolant supply. The LOW line 41 indicates a coolant level required to achieve a sufficient gas-liquid separation performance in the tank 30.

The separate chambers R1 to R6 each communicate with at least one of adjacent separate chambers via a coolant communication hole 44 positioned near a lower end of the bulkhead 42. Additionally, the separate chambers R1 to R6 each communicate with at least one of the adjacent separate chambers via air communication hole 45*a* or 45*b* positioned near an upper end of the bulkhead 42 or via an air communication hole 45*c* at the height of the FULL line 40 in the bulkhead 42.

Figure 5:
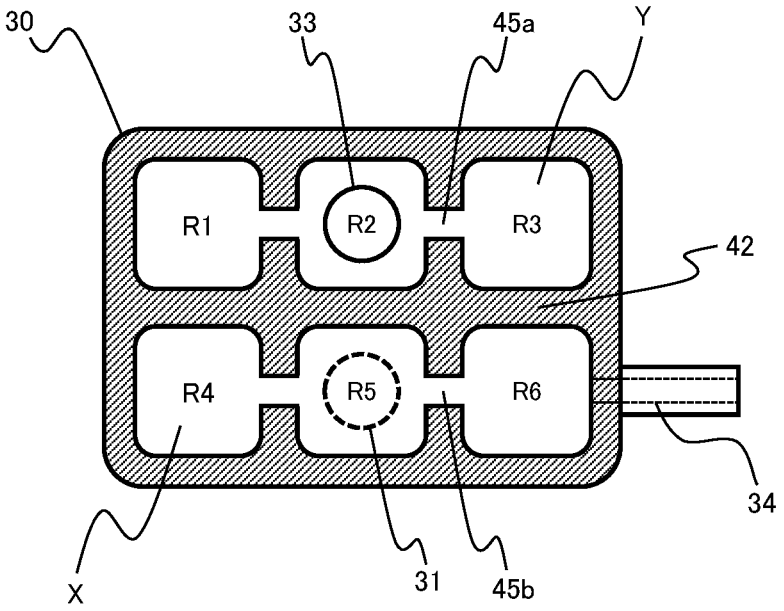
FIG. 5 is a cross-sectional view taken along line A1-A1 in FIG. 3.

FIG. 5 is a cross-sectional view taken along line A1-A1 in FIG. 3, showing a cross section taken at the height of the air communication holes 45*a* and 45*b* of the tank 30. As shown in FIG. 5, the separate chambers R4 to R6 communicate with each other via the air communication hole 45*b* and constitute a separate chamber group X. The separate chambers R1 to R3 communicate with each other via the air communication hole 45*a* and constitute a separate chamber group Y. None of the separate chambers constituting the separate chamber group X communicates with any of the separate chambers constituting the separate chamber group Y at the height of the air communication holes 45*a* and 45*b*. It is noted that each of the separate chamber group X and the separate chamber group Y is intended to include at least one separate chamber. Additionally, the separate chamber group X or the separate chamber group Y with only one separate chamber eliminates the air communication hole 45*a* or 45*b*.

Figure 6:
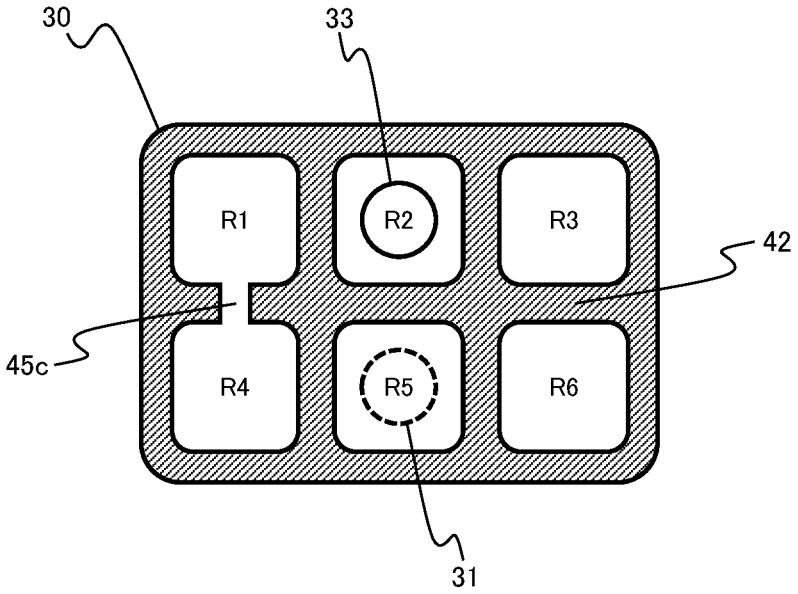
FIG. 6 is a cross-sectional view taken along line B1-B1 in FIG. 3.

FIG. 6 is a cross-sectional view taken along line B1-B1 in FIG. 3, showing a cross section taken at the height of the air communication hole 45*c* (the FULL line 40) of the tank 30. As shown in FIG. 6, the separate chamber R1 and the separate chamber R4 communicate with each other via the air communication hole 45*c*. None of the separate chambers R2, R3, R5, and R6 communicates with any of other separate chambers at the height of the air communication hole 45*c*.

Figure 7:
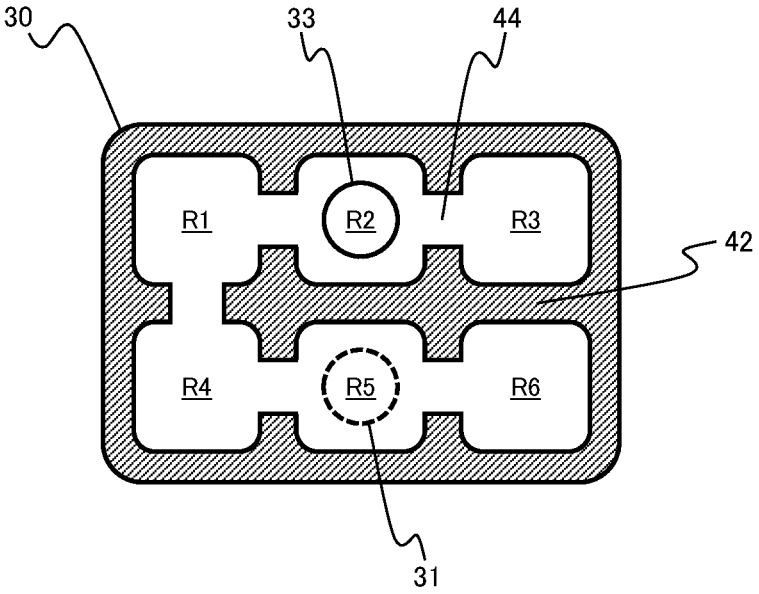
FIG. 7 is a cross-sectional view taken along line C1-C1 in FIG. 3.

FIG. 7 is a cross-sectional view taken along line C1-C1 in FIG. 3, showing a cross section taken at the height of the coolant communication hole 44 of the tank 30. As shown in FIG. 7, the separate chambers R1 to R6 communicate with each other via the coolant communication hole 44.

Figure 8:
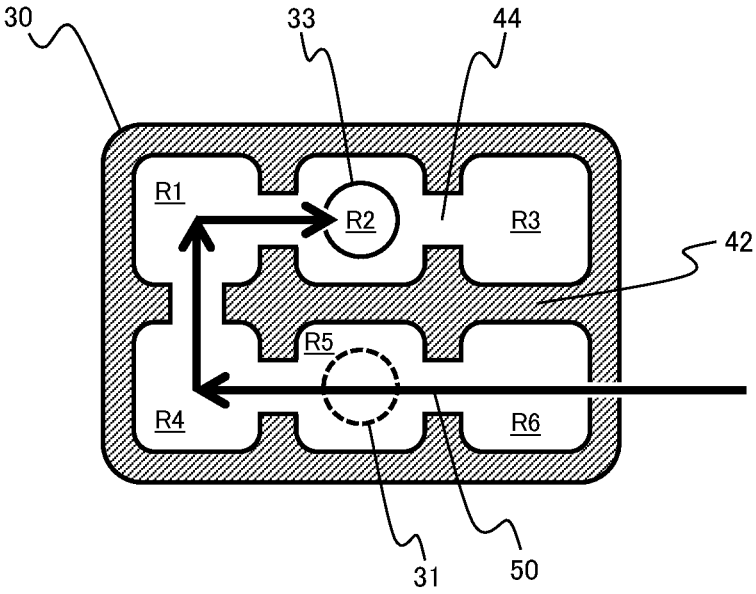
FIG. 8 is a diagram showing a main coolant flow direction in a cross section C1-C1 in FIG. 3.

FIG. 8 is a diagram showing a main coolant flow in the cross section C1-C1 in FIG. 3. As shown in FIG. 8, the separate chambers R1 to R6 form one flow path 50 at the height of the coolant communication hole 44. A majority of the coolant introduced into the separate chamber R6 through the air bleeder port 34 (see FIG. 4) is, while flowing through the separate chambers R6, R5, R4, R1, and R2, subjected to gas-liquid separation and delivered out from the make-up port 33 that opens in the bottom surface of the separate chamber R2.

Figure 9A:
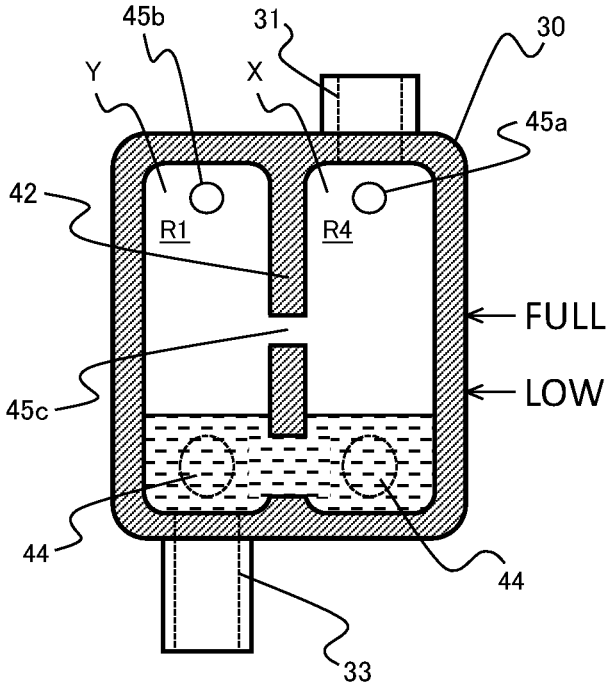
FIGS. 9A and 9B are diagrams showing change in a coolant level during coolant supply in a cross section D1-D1 in FIG. 4.
Figure 9B:
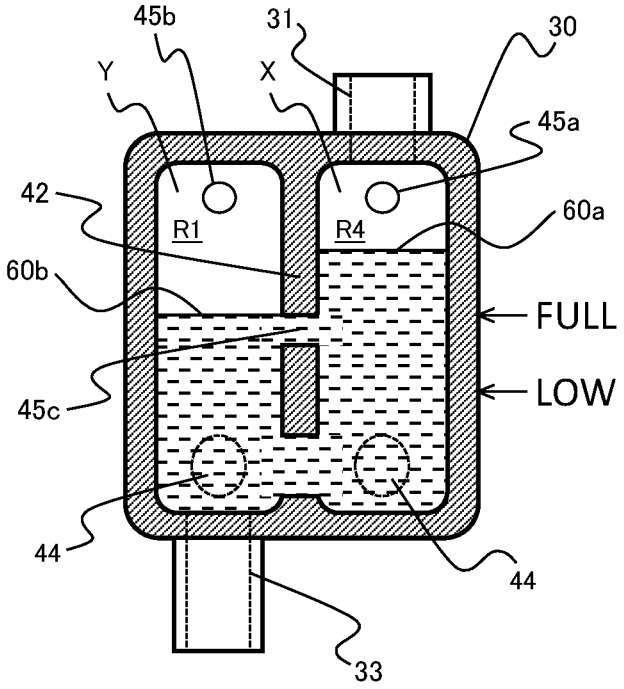

The following describes, with reference to FIGS. 5 to 7 and 9A and 9B, change in the coolant level in the separate chambers R1 to R6 when the coolant is supplied to the tank 30 beyond the FULL line 40. FIGS. 9A and 9B are diagrams showing change in the coolant level in the tank 30 during the coolant supply in a cross section D1-D1 in FIG. 4.

The coolant supplied to the separate chamber R5 via the coolant supply port 31 flows into other separate chambers R1 to R4 and R6 via the coolant communication hole 44 (see FIG. 7). At a position higher than the coolant communication hole 44, the separate chambers R1 to R3 communicate with each other via the air communication hole 45*a*, the separate chambers R4 to R6 communicate with each other via the air communication hole 45*b* (see FIG. 5), and the separate chamber R1 and the separate chamber R4 communicate with each other via the air communication hole 45*c* (see FIG. 6), so that the air in the upper portions of the separate chambers R1 to R6 can circulate freely between the separate chambers. Thus, as shown in FIG. 9A, the more the coolant level increases, the more the air remaining in the separate chambers R1 to R6 is discharged to the outside through the coolant supply port 31 that opens into the separate chamber R5. Consequently, the coolant levels in the separate chambers R1 to R6 increase equally until the levels reach the height of the air communication hole 45*c*.

Assume that the coolant supply still continues after the coolant levels in the separate chambers R1 to R6 have reached the height of the air communication hole 45*c* (the FULL line 40). Then, as shown in FIG. 9B, a coolant level 60*a* in the separate chamber group X (the separate chambers R4 to R6) increases uniformly, because the air in the separate chamber group X (the separate chambers R4 to R6) is discharged to the outside through the coolant supply port 31 that opens into the separate chamber R5. It is noted that, at a position higher than the position of the air communication hole 45*c*, the separate chamber group X (the separate chambers R4 to R6) does not communicate with the separate chamber group Y (the separate chambers R1 to R3) (see FIG. 5), so that the air remaining in the separate chamber group Y (the separate chambers R1 to R3) is not discharged to the outside through the coolant supply port 31 that opens into the separate chamber R5. This results in a coolant level. 60*b* in the separate chamber group Y (the separate chambers R1 to R3) being maintained at the height of the air communication hole 45*c* (the FULL line 40). The air communication hole 45*c* is preferably disposed at such a height that a sufficient amount of air to absorb pressure variations occurring with volume change of the coolant is secured in the separate chamber group Y (the separate chambers R1 to R3).

The tank 30 having the configuration as described above has the coolant communication hole 44 disposed such that the coolant introduced through the air bleeder port 34 flows through a plurality of (at least five) separate chambers. The gas-liquid separation performance of the coolant can thus be achieved.

Even when the coolant may be supplied beyond the FULL line 40, an air chamber having a predetermined capacity can be secured in the separate chamber group Y (the separate chambers R1 to R3), so that the air chamber can act as an air spring. Accordingly, pressure variations occurring with the volume change of the engine coolant can be absorbed.

In addition, the air communication hole 45*c* is disposed at such a height that an sufficient amount of air to absorb pressure variations in the coolant circuit occurring with volume change of the coolant is secured in the separate chamber group Y (the separate chambers R1 to R3). Thus, even when the tank 30 is supplied with coolant up to almost the upper end of the tank 30, the pressure variations occurring with volume change of the coolant can be absorbed.

In addition, the air in the separate chamber group X (the separate chambers R4 to R6) is circulated via the air communication hole 45*b* and the air in the separate chamber group Y (the separate chambers R1 to R3) is circulated via the air communication hole 45*a*. This configuration enables the coolant level in the separate chamber group X (the separate chambers R4 to R6) and the coolant level in the separate chamber group Y (the separate chambers R1 to R3) to remain uniform respectively, even when the tank 30 along with the machine is tilted. The flow in the flow path 50 inside the tank 30 thereby becomes stable, thus preventing air from being mixed into the coolant.

Furthermore, marking the tank 30 with the FULL line 40 at the height at which the air communication hole 45*c* is provided allows the operator to supply coolant using the FULL line 40 as a guide for the tank coolant level. This results in a coolant level in the separate chamber group X (the separate chambers R4 to R6) being equal to the separate chamber group Y (the separate chambers R1 to R3). The flow in the flow path 50 inside the tank 30 thereby becomes more stable, thus further preventing air from being mixed into the coolant.

Second Embodiment

A second embodiment of the present invention will be described below with reference to FIGS. 10 to 18. In FIGS. 10 to 18, like or corresponding parts are identified by the same reference numerals as those used for the parts described with reference to the first embodiment (FIGS. 1 to 9B) and descriptions for those parts will not be duplicated as appropriate.

Figure 10:
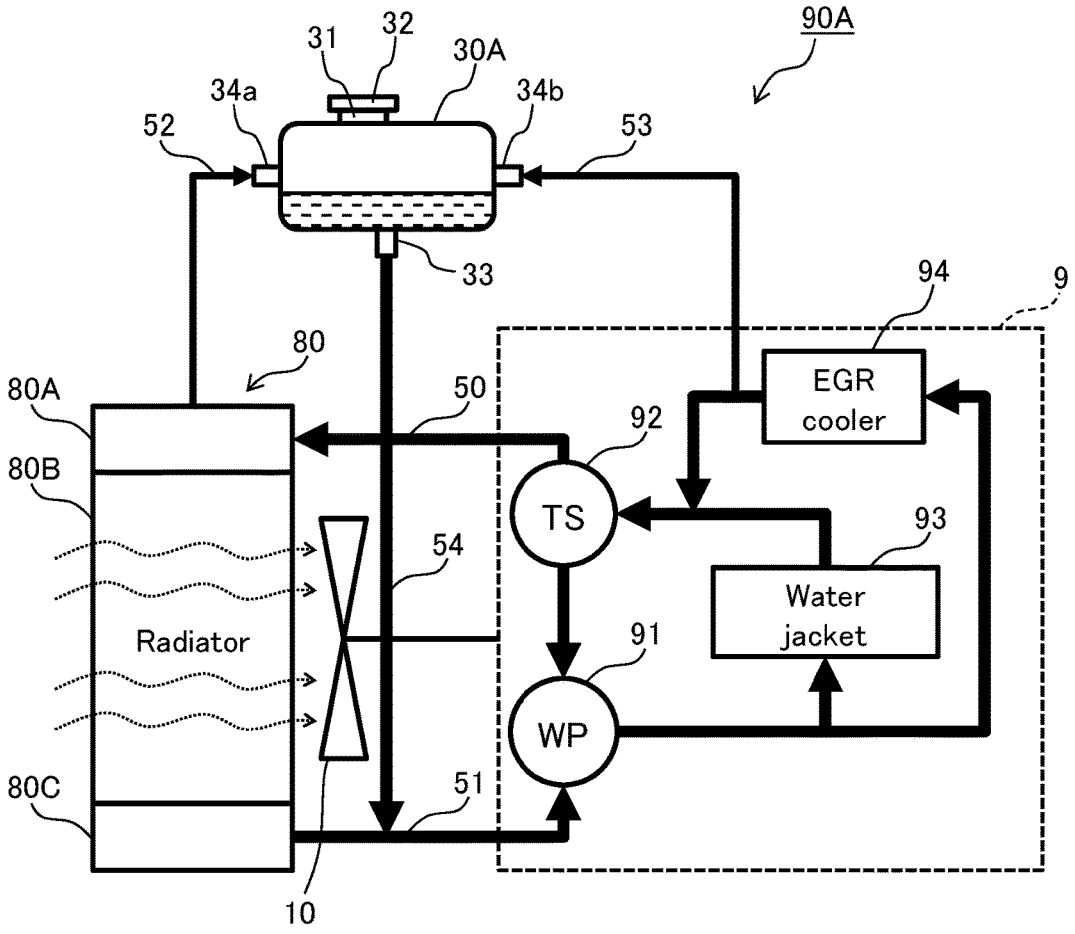
FIG. 10 is a diagram showing an overall configuration of an engine cooling apparatus that includes an expansion tank according to a second embodiment of the present invention.

FIG. 10 is a diagram showing an overall configuration of an engine cooling apparatus in the second embodiment of the present invention. An engine cooling apparatus 90A shown in FIG. 10 has the same configuration as those in the engine cooling apparatus 90 according to the first embodiment, except that an air bleeder line 53 to which the coolant extracted from a coolant flow path of an engine 9 is introduced is connected to an expansion tank 30A. In the second embodiment, the air bleeder line 53 has an end on the engine side connected to a portion at which the coolant level is the highest in the coolant flow path formed in the engine 9. The coolant containing air is extracted from that portion. The expansion tank 30A has a make-up port 33 disposed at a position higher than the position of an uppermost portion of an internal cavity of an upper tank 80A and higher than the position of the portion having the highest coolant level in the coolant flow path formed in the engine 9. In the example shown in FIG. 10, since the flow path connected to an outlet side of an EGR cooler 94 is disposed at the highest position in the engine, the air bleeder line 53 is connected to this flow path. Depending on the height of the coolant flow path, however, the air bleeder line 53 may be connected to a flow path extending from a water jacket 93 to a thermostat 92 or any other flow path.

The following describes, with reference to FIGS. 11 to 16, a configuration of the expansion tank (hereinafter referred to simply as the "tank") 30A included in the engine cooling apparatus 90A.

Figure 11:
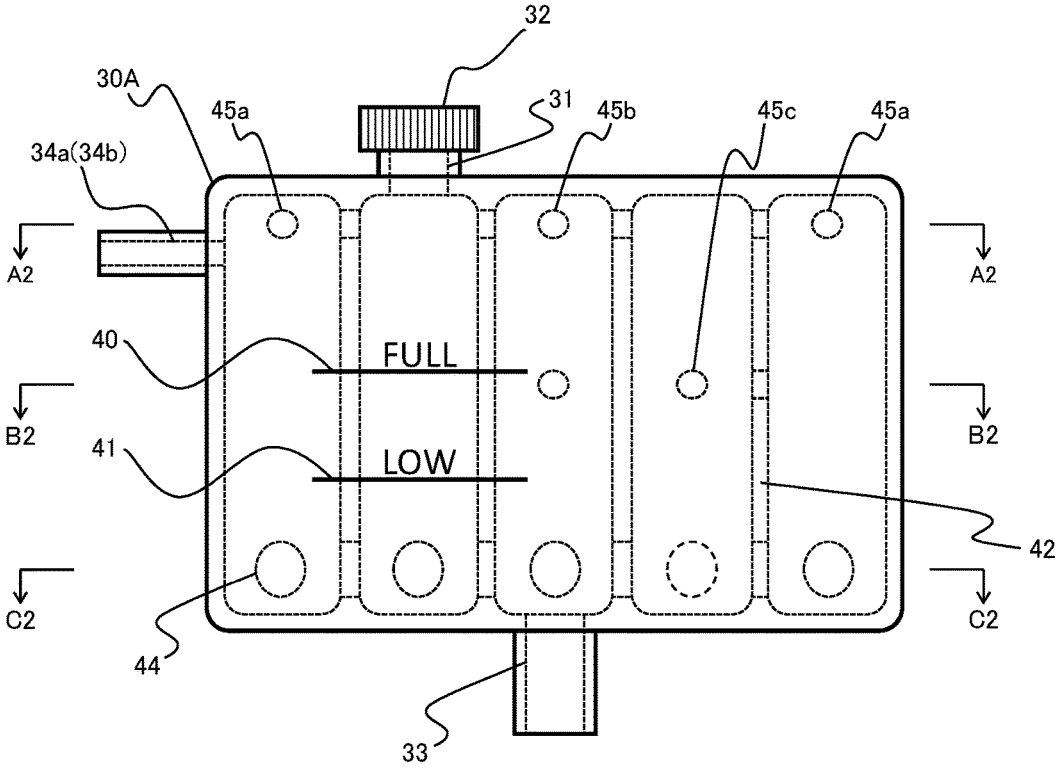
FIG. 11 is a side view showing the expansion tank according to the second embodiment.
Figure 12:
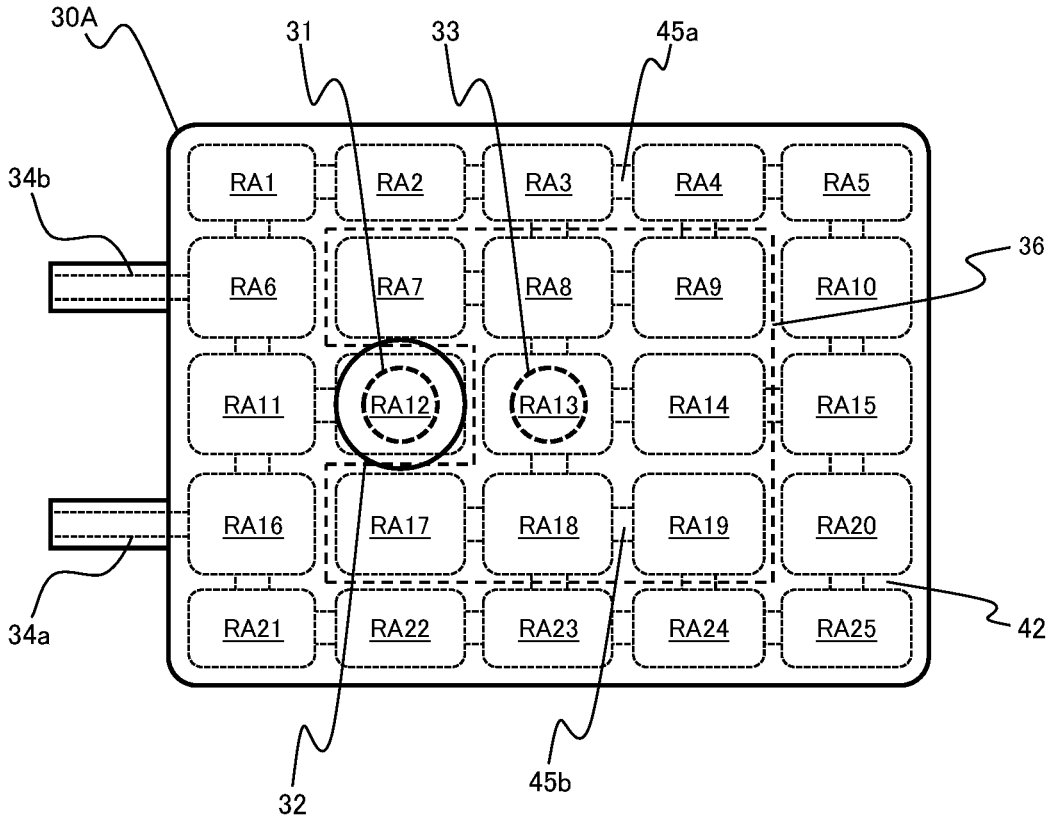
FIG. 12 is a top view showing the expansion tank according to the second embodiment.

FIG. 11 is a side view showing the tank 30A. FIG. 12 is a top view showing the tank 30A. The tank 30A has an inside partitioned by a bulkhead 42 into twenty five separate chambers RA1 to RA25. The separate chambers RA1 to RA25 are adjacent to each other in forward-backward and left-right directions and each have a quadrangular prism shape. The tank 30A has a coolant supply port 31 disposed on a top surface of the tank 30A. The coolant supply port 31 is formed so as to open into the separate chamber RA12. The tank 30A further has an air bleeder port 34*a* and an air bleeder port 34*b* disposed on a lateral surface of the tank 30A. An air bleeder line 52 on the radiator side is connected to the air bleeder port 34*a* and the air bleeder line 53 on the engine side is connected to the air bleeder port 34*b*. The air bleeder port 34*a* is formed so as to open into the separate chamber RA16 and the air bleeder port 34*b* is formed so as to open into the separate chamber RA6. The tank 30A further has the make-up port 33 for connecting a make-up line 54 disposed on a bottom surface of the tank 30A. The make-up port 33 is formed so as to open in a bottom surface of the separate chamber RA13 disposed at a position near the center of the tank 30A.

The separate chambers RA1 to RA25 each communicate with at least one of the adjacent separate chambers via a coolant communication hole 44 positioned near a lower end of the bulkhead 42. Additionally, the separate chambers RA1 to RA25 each communicate with at least one of the adjacent separate chambers via air communication hole 45*a* or 45*b* positioned near an upper end of the bulkhead 42 or via an air communication hole 45*c* positioned at the height of a FULL line 40 in the bulkhead 42.

Figure 13:
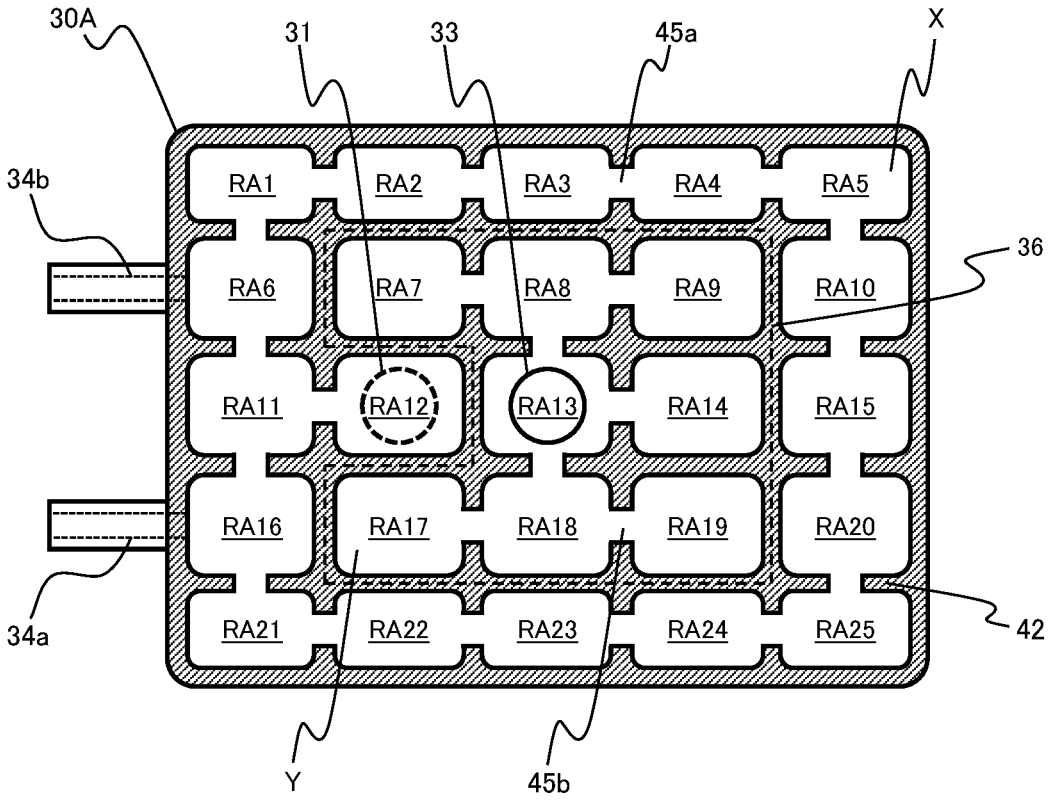
FIG. 13 is a cross-sectional view taken along line A2-A2 in FIG. 11.

FIG. 13 is a cross-sectional view taken along line A2-A2 in FIG. 11, showing a cross section taken at the height of the air communication holes 45*a* and 45*b* in the tank 30A. As shown in FIG. 13, the separate chambers RA1 to RA5, RA6, RA10, RA11, RA15, RA16, and RA20 to RA25, and the separate chamber RA12 into which the coolant supply port 31 opens (the separate chambers disposed on the outside of a broken line frame 36) communicate with each other via the air communication hole 45*a* and thus constitute a separate chamber group X. Similarly, the separate chambers RA7 to RA9, RA13, RA14, and RA17 to RA19 (the separate chambers disposed on the inside of the broken line frame 36) communicate with each other via the air communication hole 45*b* and thus constitute a separate chamber group Y. None of the separate chambers constituting the separate chamber group X communicates with any of the separate chambers constituting the separate chamber group Y at the height of the air communication holes 45*a* and 45*b*.

Figure 14:
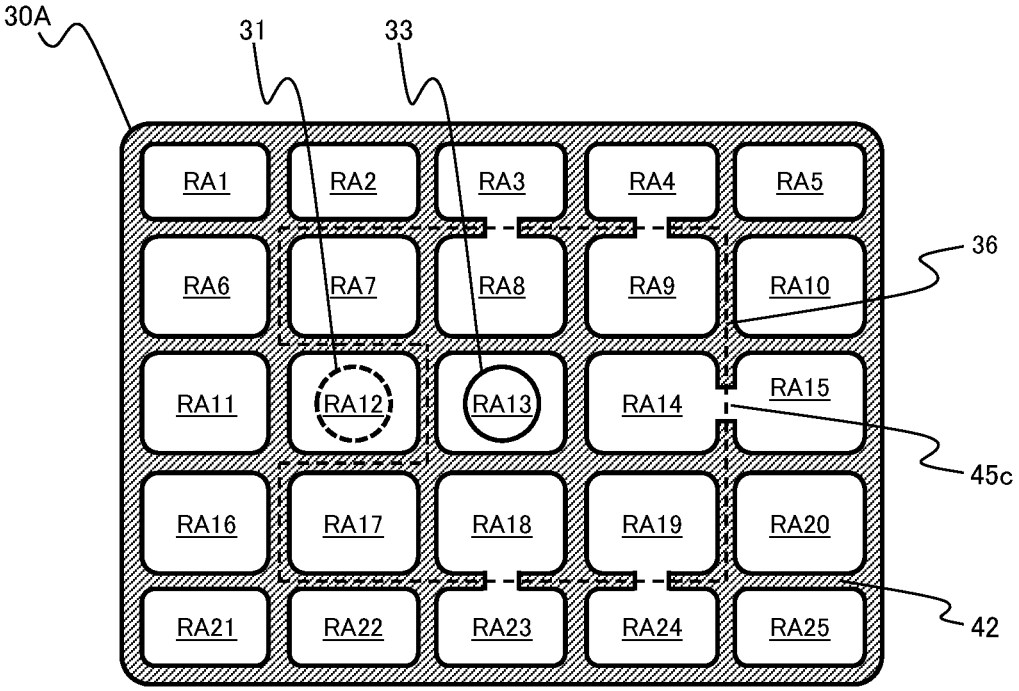
FIG. 14 is a cross-sectional view taken along line B2-B2 in FIG. 11.

FIG. 14 is a cross-sectional view taken along line B2-B2 in FIG. 11, showing a cross section taken at the height of the air communication hole 45*c* (the FULL line 40) of the tank 30A. As shown in FIG. 14, the air communication hole 45*c* provides communication between the separate chamber RA3 and the separate chamber RA8, between the separate chamber RA4 and the separate chamber RA9, between the separate chamber RA14 and the separate chamber RA15, between the separate chamber RA18 and the separate chamber RA23, and between the separate chamber RA19 and the separate chamber RA24. None of the other separate chambers communicates with any of the separate chambers at the height of the air communication hole 45*c*.

Figure 15:
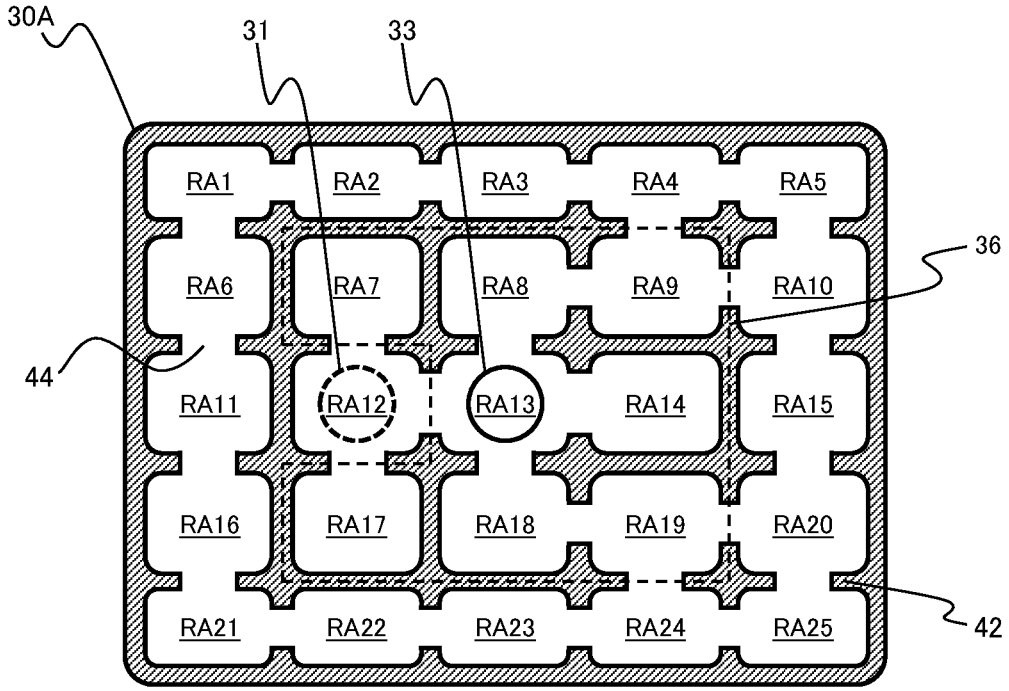
FIG. 15 is a cross-sectional view taken along line C2-C2 in FIG. 11.

FIG. 15 is a cross-sectional view taken along line C2-C2 in FIG. 11, showing a cross section taken at the height of the coolant communication hole 44 of the tank 30A. As shown in FIG. 15, the separate chambers RA1 to RA25 each communicate with at least one of the adjacent chambers via the coolant communication hole 44.

Figure 16:
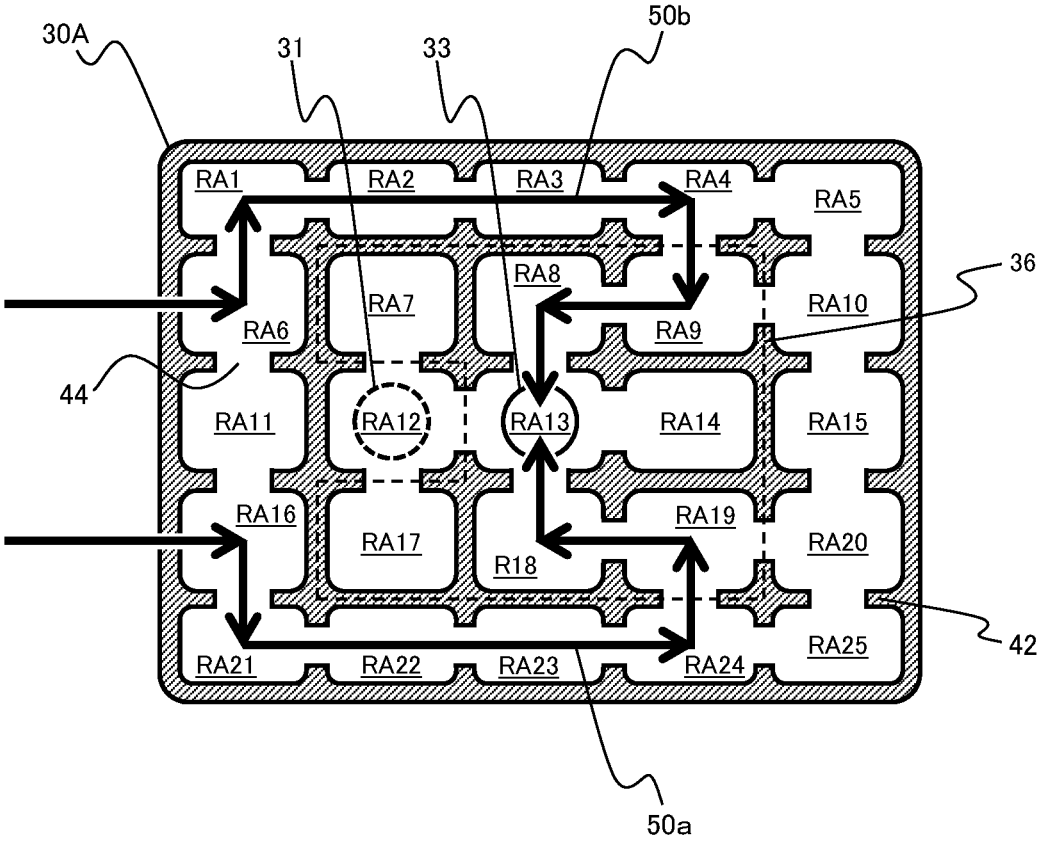
FIG. 16 is a diagram showing a main coolant flow direction in a cross section C2-C2 in FIG. 11.

FIG. 16 is a diagram showing a main coolant flow direction in a cross section C2-C2 in FIG. 11. As shown in FIG. 16, the separate chambers RA16, RA21, RA22, RA23, RA24, RA19, RA18, and RA13 form a main flow path 50*a* extending from the air bleeder port 34*a* on the radiator side to the make-up port 33. Similarly, the separate chambers RA6, RA1 to RA4, RA9, RA8, and RA13 form a main flow path 50*b* extending from the air bleeder port 34*b* on the engine side to the make-up port 33. A majority of the coolant introduced into the separate chamber R16 through the air bleeder port 34*a* on the radiator side (see FIG. 12) is, while flowing through the separate chambers that constitute the flow path 50*a*, subjected to gas-liquid separation and delivered out from the make-up port 33 that opens in the bottom surface of the separate chamber R13. Meanwhile, a majority of the coolant introduced into the separate chamber R6 through the air bleeder port 34*b* on the engine side (see FIG. 12) is, while flowing through the separate chambers that constitute the flow path 50*b*, subjected to gas-liquid separation and delivered out from the make-up port 33 that opens in the bottom surface of the separate chamber R13. It is noted that FIG. 16 exemplifies the flow paths 50*a* and 50*b* when coolant is introduced equally from the air bleeder ports 34*a* and 34*b*, and a different flow path will be formed in accordance with a disposition of the coolant communication hole 44, the diameter of the coolant communication hole 44, and the flow rates of coolant introduced through the air bleeder ports 34*a* and 34*b*.

Figure 17:
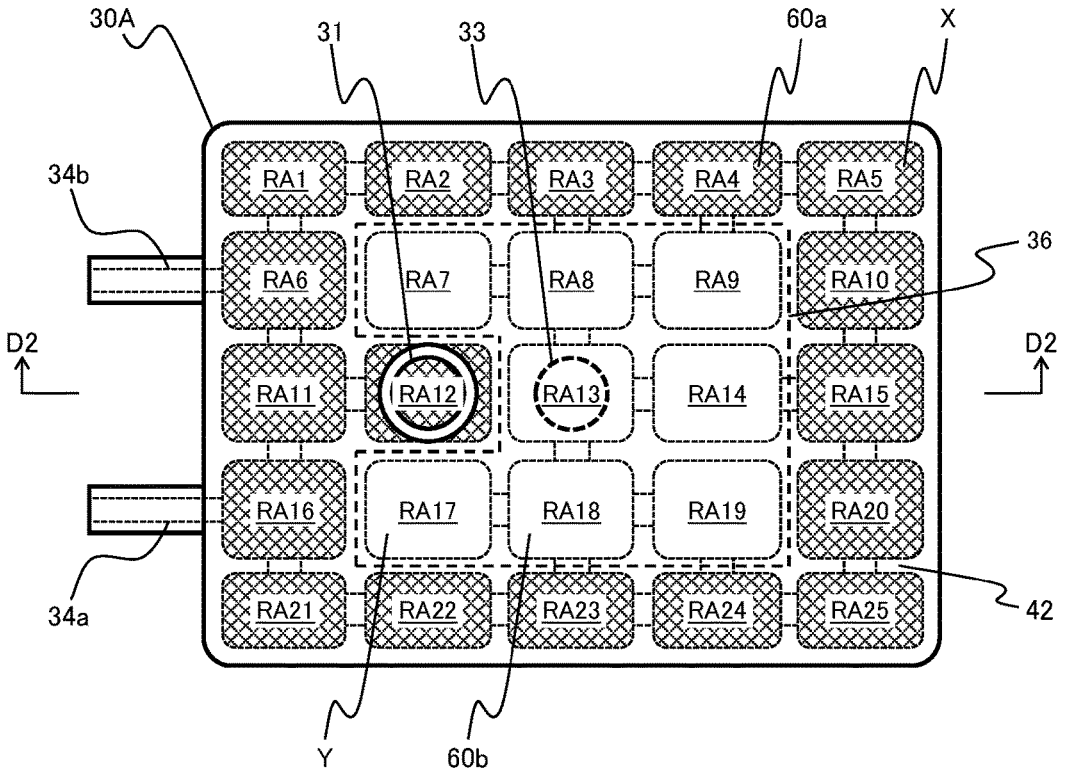
FIG. 17 is a top view showing the expansion tank supplied with coolant beyond a FULL line.
Figure 18:
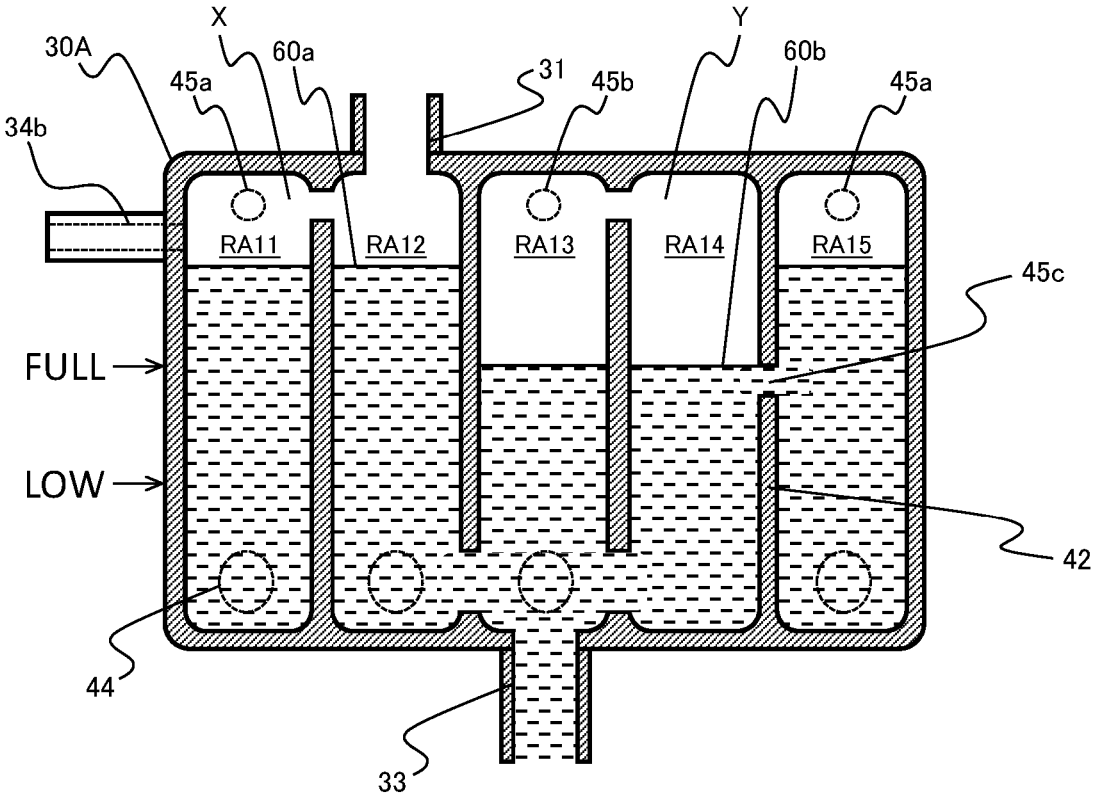
FIG. 18 is a cross-sectional view taken along line D2-D2 in FIG. 17.

The following describes, with reference to FIGS. 17 and 18, change in the coolant level in the separate chambers RA1 to RA25 when the coolant is supplied to the tank 30A beyond the FULL line 40. FIG. 17 is a top view showing the tank 30A supplied with coolant beyond the FULL line 40. FIG. 18 is a cross-sectional view taken along line D2-D2 in FIG. 17.

When the tank 30A according to the second embodiment is supplied with coolant, the coolant levels in the separate chambers RA1 to RA25 increase equally until the levels reach the height of the air communication hole 45*c*, as in the first embodiment. The coolant supply may continue after the coolant levels in the separate chambers RA1 to RA25 have reached the height of the air communication hole 45*c* (the FULL line 40). In such a case, a coolant level 60*a* in the separate chamber group X (indicated by cross-hatched patterns in FIG. 17) increases uniformly, because the air remaining at upper portions in the separate chamber group X is discharged to the outside through the coolant supply port 31 that opens into the separate chamber R12 (see FIG. 18). It is noted that, at a position higher than the height of the air communication hole 45*c*, the separate chamber group X does not communicate with the separate chamber group Y (see FIG. 13), so that the air in the separate chamber group Y is not discharged to the outside through the coolant supply port 31 that opens into the separate chamber R12. This results in a coolant level 60*b* in the separate chamber group Y (indicated by blank patterns in FIG. 17) being maintained at the height of the air communication hole 45*c* (the FULL line 40) (see FIG. 18).

The tank 30A having the configuration as described above has the coolant communication hole 44 disposed such that the coolant introduced through the air bleeder ports 34*a* and 34*b* flows through a plurality of (at least eight) separate chambers. This achieves gas-liquid separation performance of the coolant regardless of whether the coolant is introduced from the air bleeder port 34*a* or the air bleeder port 34*b*.

Even when the coolant is supplied beyond the FULL line 40, an air chamber having a predetermined capacity can be secured in the separate chamber group X, so that the air chamber can act as an air spring. Accordingly, pressure variations occurring with the volume change of the engine coolant can be absorbed.

In addition, the air communication hole 45*c* is disposed at such a height that an sufficient amount of air to absorb pressure variations in the coolant circuit occurring with volume change of the coolant is secured in the separate chamber group X. Thus, even when the tank 30A is supplied with coolant up to almost the upper end of the tank 30A, the pressure variations occurring with volume change of the coolant can be absorbed.

In addition, the air is circulated via the air communication hole 45*a* between the separate chambers constituting the separate chamber group X, and the air is circulated via the air communication hole 45*b* between the separate chambers constituting the separate chamber group Y. This configuration enables the coolant level in the separate chamber group X and the coolant level in the separate chamber group Y to remain uniform respectively, even when the tank 30A is tilted along with the machine. The flow in the flow paths 50*a* and 50*b* inside the tank 30A thereby becomes stable, thus preventing air from being mixed into the coolant.

Furthermore, marking the tank 30A with the FULL line 40 at the height at which the air communication hole 45*c* is provided allows the operator to supply coolant using the FULL line 40 as a guide for the tank coolant level. This results in a coolant level in the separate chamber group X being equal to the separate chamber group Y. The flow in the flow paths 50*a* and 50*b* inside the tank 30A thereby becomes more stable, thus further preventing air from being mixed into the coolant.

The make-up port 33 is formed so as to open in the bottom surface of the separate chamber R13 that is disposed at a position near the center of the tank 30A. This configuration maintains an adequate distance between the opening in the make-up port 33 and a coolant surface, even when the tank 30A is tilted in any direction along with the machine. Thus, air from the make-up port 33 can be prevented from being mixed into the coolant circuit.

Additionally, disposing the separate chamber group X in which the coolant level may exceed the FULL line 40 so as to surround the separate chamber group Y in which the coolant level is maintained at the FULL line 40 allows the operator to accurately recognize change in the amount of coolant in the tank 30A from the outside. An overflow of coolant from the tank 30A is thus less likely to occur during coolant supply.

It should be understood that the embodiments described above are not intended to limit the present invention and various change in form and detail may be made therein without departing from the spirit and scope of the invention. For example, while the tanks 30 and 30A are disposed such that the make-up port 33 is higher than an uppermost portion of the internal cavity of the upper tank 80A, the tanks 30 and 30A may be disposed such that the make-up port 33 is lower than the uppermost portion of the internal cavity of the upper tank 80A, only if the LOW line 41 is higher than the uppermost portion of the internal cavity of the upper tank 80A. Moreover, the present invention encompasses embodiments in which part of the elements that constitute the above-described embodiments is eliminated, in addition to the embodiments that include all the elements described above. Furthermore, part of the elements in one embodiment may be combined with the elements in another embodiment or replaced with part of elements in another embodiment.

What is claimed is:

1. An expansion tank performing gas-liquid separation of coolant in a condition of being closed from an atmosphere, comprising:

a bleeder port allowing coolant that circulates through the engine cooling apparatus to be introduced into the expansion tank;

a make-up port allowing coolant to be delivered from the expansion tank to a coolant circuit of the engine cooling apparatus;

a coolant supply port allowing coolant to be supplied to the expansion tank from outside of the expansion tank in a condition of the expansion tank being opened to the atmosphere;

a bulkhead partitioning an inside of the expansion tank;

a first separate chamber group that is constituted by separate chambers partitioned by the bulkhead; and a second separate chamber group that is constituted by separate chambers partitioned by the bulkhead, wherein the bleeder port is formed so as to open into one of the separate chambers constituting the first separate chamber group at a higher position than a predetermined height;

the make-up port is formed so as to open into one of the separate chambers constituting the second separate chamber group at a lower position than the predetermined height;

the coolant supply port is formed so as to open into one of the separate chambers constituting the first separate chamber group at a higher position than the predetermined height;

the separate chambers constituting the first separate chamber group and the separate chambers constituting the second separate chamber group communicate with one another via coolant communication holes that are formed at a lower position than the predetermined height in the bulkhead;

the separate chambers constituting the first separate chamber group communicate with one another via air communication holes that are formed at a higher position than the predetermined height in the bulkhead;

the separate chambers constituting the separate chamber group communicate with one another via air communication holes that are formed at a higher position than the predetermined height in the bulkhead;

at least one of the separate chamber chambers constituting the first separate chamber group communicates with one of the separate chambers constituting the second separate chamber group via an air communication hole that is formed at the predetermined height in the bulkhead; and the predetermined height is set in accordance with an amount of air that can absorb pressure variations occurring with the volume change of the coolant.

2. The expansion tank according to claim 1, wherein the separate chambers constituting the first separate chamber group are, in a plane view, disposed around the separate chambers constituting the second separate chamber group.

3. The expansion tank according to claim 2, wherein the make-up port is formed so as to open in a bottom surface of one separate chamber of the separated chambers constituting the second separate chamber group, the one separate chamber being disposed closest to a center of the expansion tank.

* * * * *